US010674802B2

(12) United States Patent
Sog

(10) Patent No.: US 10,674,802 B2
(45) Date of Patent: Jun. 9, 2020

(54) PEN TYPE COSMETICS CASE

(71) Applicant: LINE PLUS CORPORATION, Chungcheongbuk-do (KR)

(72) Inventor: Jong Wan Sog, Goyang-si (KR)

(73) Assignee: LINE PLUS CORPORATION, Chungcheongbuk-Do (KR)

( * ) Notice: Subject to any disclaimer, the term of this patent is extended or adjusted under 35 U.S.C. 154(b) by 23 days.

(21) Appl. No.: 16/107,167

(22) Filed: Aug. 21, 2018

(65) Prior Publication Data

US 2019/0231051 A1 Aug. 1, 2019

(30) Foreign Application Priority Data

Jan. 31, 2018 (KR) ..... 10-2018-0012104

(51) Int. Cl.

| | |
|---|---|
| ***A45D 34/04*** | (2006.01) |
| ***A45D 40/06*** | (2006.01) |
| ***A45D 40/04*** | (2006.01) |
| ***A45D 40/20*** | (2006.01) |

(52) U.S. Cl.

CPC ..... *A45D 34/042* (2013.01); *A45D 40/06* (2013.01); *A45D 40/04* (2013.01); *A45D 40/20* (2013.01); *A45D 2200/055* (2013.01)

(58) Field of Classification Search

CPC ..... A45D 34/042; A45D 40/02; A45D 2200/1018; A45D 2200/055; A45D 40/04; A45D 40/06; A45D 40/20; A45D 40/205; A45D 2200/054; B65D 83/0005; B65D 83/0011; B65D 83/0022

See application file for complete search history.

(56) References Cited

U.S. PATENT DOCUMENTS

| | | | | |
|---|---|---|---|---|
| 6,592,278 | B1 * | 7/2003 | Holthaus | A45D 40/04 401/66 |
| 8,764,335 | B2 * | 7/2014 | Uehara | A45D 34/04 401/172 |

FOREIGN PATENT DOCUMENTS

| | | | |
|---|---|---|---|
| JP | 3770636 | B2 | 4/2006 |
| JP | 2014-046153 | A | 3/2014 |
| KR | 1020090014285 | A | 2/2009 |
| KR | 10-1409004 | B1 | 6/2014 |
| KR | 10-1602925 | B1 | 3/2016 |
| KR | 10-1733569 | B1 | 5/2017 |
| KR | 1020140045280 | | 4/2018 |

OTHER PUBLICATIONS

International Search Report from corresponding International Application No. PCT/KR2018/009073, dated Oct. 31, 2018, pp. 1-4, Korean Intellectual Property Office, Daejeon, Republic of Korea.
Korean Office Action issued in corresponding Korean Patent Application No. 10-2018-0012104, dated Mar. 25, 2019, pp. 1-7, Korean Intellectual Property Office, Daejeon, Republic of Korea.

* cited by examiner

*Primary Examiner* — David J Walczak
(74) *Attorney, Agent, or Firm* — Hauptman Ham, LLP

(57) ABSTRACT

A pen type cosmetics case that pushes contents to a nozzle through a forward movement of a piston, and more particularly, a pen type cosmetics case capable of recovering contents injected into a nozzle by constituting a piston so as to be able to move forward as well as backward.

11 Claims, 16 Drawing Sheets

PEN TYPE COSMETICS CASE

CROSS-REFERENCE TO RELATED APPLICATIONS

This application claims priority under 35 U.S.C. § 119 to Korean Patent Application No. 10-2018-0012104, filed on Jan. 31, 2018, in the Korean Intellectual Property Office, the disclosure of which is incorporated herein by reference in its entirety.

TECHNICAL FIELD

The following disclosure relates to a pen type cosmetics case that pushes contents to a nozzle through a forward movement of a piston, and more particularly, to a pen type cosmetics case capable of recovering contents injected into a nozzle by constituting a piston so as to be able to move forward as well as backward.

BACKGROUND

In general pen type cosmetics (eyeliner, concealer, lip tint, lip gloss, etc.), when a filling liquid suitable for the purpose of use is put into a cylinder type case and an operation part such as a knock button is operated, a piston moves forward and an inner filling liquid has been used to draw an eyebrow or as cosmetics such as concealers, lip lacquers, and lip tints by being pushed out through a brush, sponge or soft silicone typically called an applicator.

However, as described above, the pen type cosmetics case operated by the knock button was not able to recover the liquid cosmetics pushed out through the brush, the sponge, or the soft silicone.

In addition, since the cosmetics case of the knock type is difficult to adjust an amount of contents injected into the nozzle, there is an inconvenience that when the contents are excessively pushed out to the nozzle, the contents may not be recovered and therefore, the pushed contents should be wiped with a tissue or the like and used.

In particular, in a case in which the liquid cosmetics are stored in a state in which the liquid cosmetics are injected into the nozzle such as the brush, the sponge, or the silicone, the liquid cosmetics become solidified and are difficult to use, and the nozzle is clogged due to the solid matter, which is troublesome to use after cleaning the nozzle.

RELATED ART DOCUMENT

Patent Document

Korean Patent Laid-Open Publication No. 10-2014-0045280 ('Knock-Type Propelling Container' published on Apr. 16, 2014)

SUMMARY

An embodiment of the present invention is directed to providing a pen type cosmetics case capable of recovering contents injected into a nozzle by constituting a piston so as to be able to move forward as well as backward through a rotary operation part.

Another embodiment of the present invention is directed to providing a pen type cosmetics case capable of injecting or recovering contents into or from a nozzle by an amount of contents intended by a user by allowing protrusions and tooth grooves to be periodically engaged with each other when a rotary operation part is rotated.

Still another embodiment of the present invention is directed to providing a pen type cosmetics case that selectively uses a rotary operation part or a knock operation part according to a convenience of a user in a forward movement of a piston, and uses the rotary operation part in a backward movement of the piston by additionally constituting the knock operation part in the rotary operation part.

In one general aspect, a pen type cosmetics case includes a body having contents accommodated therein; a nozzle part coupled to one end of the body in a length direction thereof to discharge the contents; a piston coupled to an inner portion of the body so as to perform a reciprocating motion along the length direction of the body; a piston rod coupled to the other side of the piston and having a screw thread formed on an outer surface thereof; a fixing cam coupled to the other side of the body and having a screw thread formed on an inner surface so that the piston rod is screwed; and a rotor coupled rotatably to the other side of the body and connected to the other side of the piston rod, wherein the piston rod rotates in conjunction with the rotor, and the piston rod moves the piston forward when the rotor rotates in one direction, and moves the piston backward when the rotor rotates in the other direction.

In another general aspect, a pen type cosmetics case includes a body having a hollowed inner portion and opened both sides; a piston coupled to the inner portion of the body so as to perform a reciprocating motion along a length direction of the body; solid contents accommodated in the body and coupled to one side of the piston; a piston rod coupled to the other side of the piston and having a screw thread formed on an outer surface thereof; a fixing cam coupled to the other side of the body and having a screw thread formed on an inner surface so that the piston rod is screwed; and a rotor coupled rotatably to the other side of the body and connected to the other side of the piston rod, wherein the piston rod rotates in conjunction with the rotor, and the piston rod moves the piston forward when the rotor rotates in one direction, and moves the piston backward when the rotor rotates in the other direction.

The contents may be injected into the nozzle part when the piston moves to one side and may be recovered from the nozzle part when the piston moves to the other side, or the solid contents may move forward to the outside of one side of the body when the piston moves to one side and may be recovered into the inner portion of the body when the piston moves to the other side.

A plurality of tooth grooves may be formed at a predetermined interval along a circumference direction in a periphery of one end of the rotor, an elastic protrusion may be formed at the other end of the fixing cam so as to be engaged with any one tooth groove of the tooth grooves, and when the rotor rotates, the elastic protrusion may be sequentially engaged with the plurality of tooth grooves.

The elastic protrusion may include a support extended from the other end of the fixing cam to the other side; an elastic piece extended along a periphery of the fixing cam from the support; and an elastic protrusion protruding from an end of the elastic piece to the other side.

A movement distance to one side or the other side of the piston may be induced by a pitch between the tooth groove and a neighboring tooth groove when the rotor rotates.

The pen type cosmetics case may further include a knock part included in the rotor and moving the piston rod to one side in the length direction separately from the rotation of the rotor.

The knock part may include a knock button provided to perform a reciprocating motion along the length direction on the rotor and having one end inserted into the rotor and the other end exposed to the outside; and a rotary cam provided inside the rotor so as to be rotatable adjacent to one side of the knock button and to which the other end of the piston rod is inserted so that the piston rod rotates in conjunction with the rotary cam, a gear may be formed at one end of the knock button and an inclined surface gear engaged with the gear may be formed at the other end of the rotary cam, such that when the knock button moves to one side of the length direction, the rotary cam may rotate in one direction by a pitch of the inclined surface gear, and the piston rod may rotate by a rotation length of the rotary cam.

The rotary cam may be inserted into the rotor and have a side surface protrusion gear engaged with an inward protrusion gear formed inside the rotor so as to rotate in conjunction with the rotor, the side surface protrusion gear being formed on an outer circumferential surface of the rotary cam, and when the knock button moves to one side of the length direction, the rotary cam may be pushed to one side direction by the knock button and the side surface protrusion gear may be disengaged from the inward protrusion gear.

The knock part may include an elastic spring elastically supporting the knock button or the rotary cam so that the knock button returns to the other side after moving to one side.

BRIEF DESCRIPTION OF THE DRAWINGS

(FIG. 8A illustrates when the rotor and the fixing cam are engaged with each other and FIG. 8B illustrates when the rotor and the fixing cam are released).

DETAILED DESCRIPTION OF MAIN ELEMENTS

Figure 1:
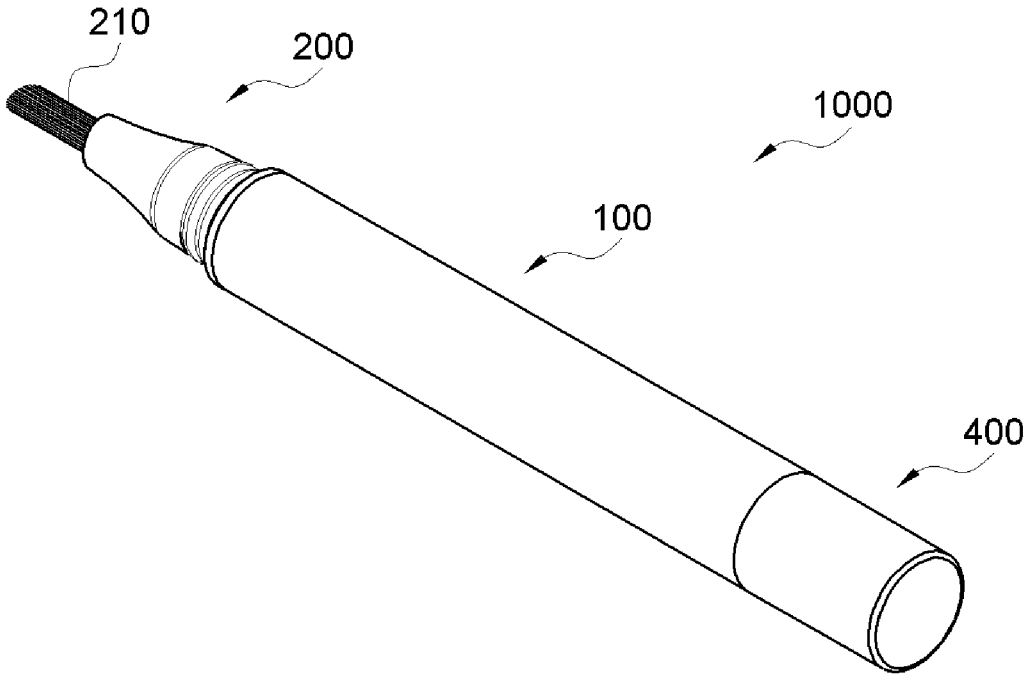
FIG. 1 is an overall perspective view of a pen type cosmetics case according to a first exemplary embodiment of the present invention.

1000, 2000, 5000: cosmetics case
100, 500, 1100: body
200, 600: nozzle part
1200: solid contents
300, 700, 1300: piston
310, 710, 1310: piston rod
400, 800, 1400: driving part
900, 1500: knock part

DETAILED DESCRIPTION OF EMBODIMENTS

Hereinafter, an exemplary embodiment of the present invention will be described in detail with reference to the accompanying drawings.

First Exemplary Embodiment (Rotary Type)

Figure 2:
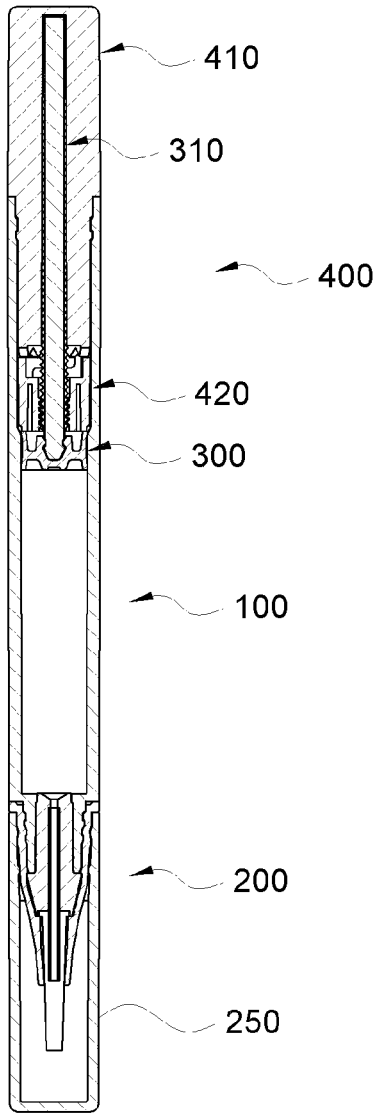
FIG. 2 is a cross-sectional view of the pen type cosmetics case according to the first exemplary embodiment of the present invention.

FIG. 1 illustrates an overall perspective view of a pen type cosmetics case 1000 (hereinafter, referred to as a "case") according to a first exemplary embodiment of the present invention and FIG. 2 illustrates a cross-sectional view of the pen type cosmetics case 1000 according to the first exemplary embodiment of the present invention. In addition, FIG. 3 illustrates an exploded perspective view of the pen type cosmetics case 1000 according to the first exemplary embodiment of the present invention.

Figure 3:
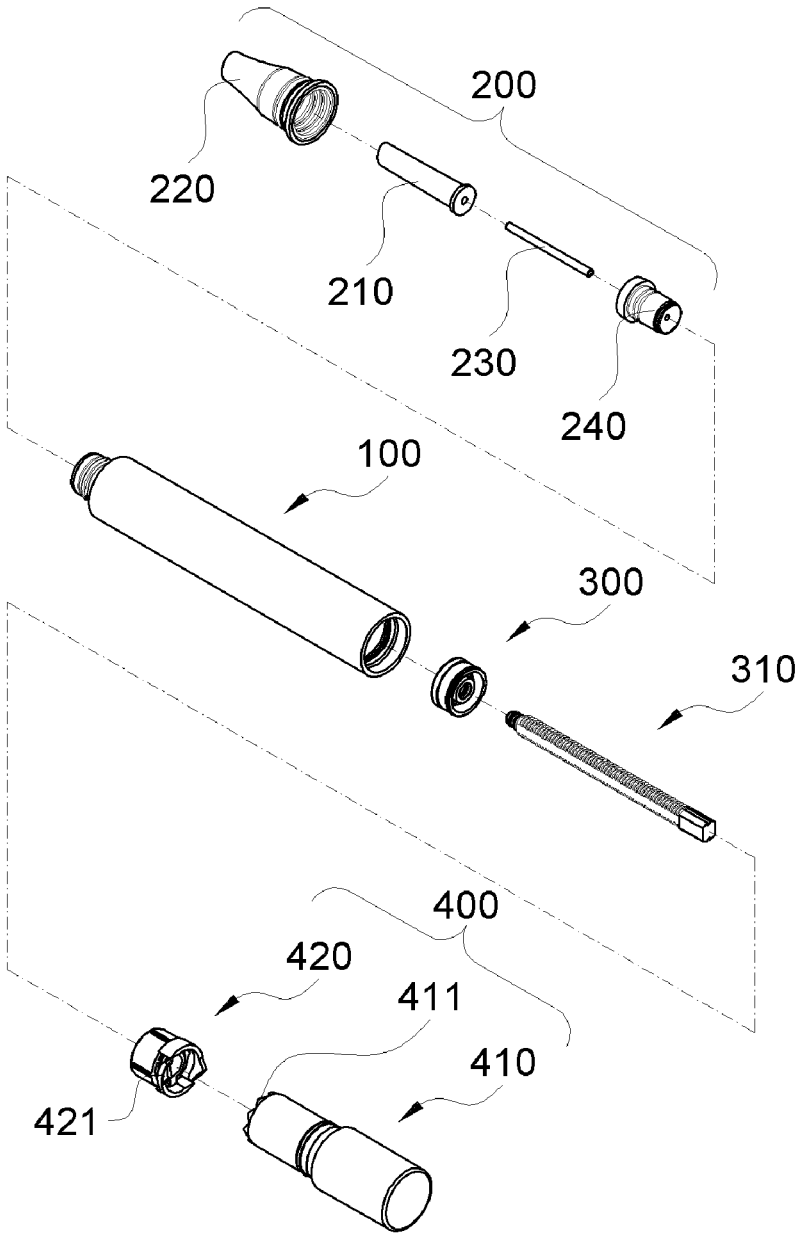
FIG. 3 is an exploded perspective view of the pen type cosmetics case according to the first exemplary embodiment of the present invention.

Referring to FIGS. 1 to 3, the case 1000 may generally include a body 100, a nozzle part 200, a piston 300, a piston rod 310, and a driving part 400, and the driving part 400 may include a rotor 410 and a fixing cam 420. Although the nozzle part 200 is illustrated on the drawing to include a brush 210, the nozzle part including one of various configurations such as a brush, a sponge, and a porous resin for the role of an eyeliner, a concealer, a lip tint or a lip gloss may be applied. Hereinafter, a description will be made by defining the nozzle part 200 side as one side and defining the driving part 400 side as the other side in relation to a length direction of the body 100 for convenience.

Although an exemplary embodiment in which the case 1000 according to the first exemplary embodiment of the present invention fills liquid contents into the body 100 and injects the liquid contents into the nozzle part 200 by a reciprocating motion of the piston 300 is illustrated, an exemplary embodiment in which solid contents such as a lipstick are accommodated in the body 100 and are coupled to one side of the piston 300, and the nozzle part 200 is removed to protrude the solid contents to the outside of one side of the body 100 or to insert the solid contents into the body 100 through the reciprocating motion of the piston 300 is also possible. The exemplary embodiment as described above will be described below with reference to the drawings.

Detailed configurations of the body 100, the nozzle part 200, the piston 300, the piston rod 310, and the driving part 400 will be described in more detail with reference to FIGS. 2 and 3. The body 100 is formed in a cylindrical shape having a hollow inner portion so that the contents are filled in the inner portion thereof.

The nozzle part 200 includes a brush 210 that directly discharges the contents of the body 100 to a user as a configuration fastened to one side of the body 100 to allow the contents of the body 100 to be injected thereto and to discharge the contents of the body 100 to the outside, a nozzle fixing cap 220 for fixing the brush 210 to one side of the body 100, a nozzle core 230 transferring the contents injected from the body 100 to the nozzle part 200 to the brush 210, and a core fixing cap 240 for fixing the nozzle core 230 to one side of the body 100. Meanwhile, the nozzle part 200 may further include a protective cap 250 for protecting the brush 210 and preventing evaporation of the contents.

The piston 300 is provided in the body 100 and is configured to inject the contents in the body 100 to the nozzle part 200 through a movement in one side in a length direction of the body 100, that is, a forward movement, and to recover the contents injected into the nozzle part 200 through a movement in the other side in the length direction of the body 100, that is, a backward movement.

One end of the piston rod 310 is connected to the other side of the piston 300 and the other end thereof is connected to the driving part 400 described above. The piston rod 310 is configured to move to one side or the other side in the length direction through driving of the driving part 400 to move the piston 300 forward or backward. A coupling relationship and operation of the piston rod 310 and the driving part 400 will be described below with reference to the detailed drawings of the respective components.

The driving part 400 includes a rotor 410 rotatably coupled to the other side of the body 100 and a fixing cam 420 fixed to an inner portion of the other side of the body 100. The rotor 410 is exposed to the outside to allow the user to apply rotational force, and is configured to rotate the piston rod 310 through rotation. The fixing cam 420 is configured to be screwed with the piston rod 310 to move the piston rod 310 to one side or the other side in the length direction when the piston rod 310 rotates. In addition, a plurality of tooth grooves 411 are formed along a circumferential direction at one end of the rotor 410 and elastic protrusions 421 are formed at the other end of the fixing cam 420 such that the elastic protrusions 421 are periodically engaged with the tooth grooves 411 to thereby induce rotation of the rotor 410 to inject or recover the contents into or from the nozzles by an amount that the user intends.

Hereinafter, an operation example of the case 1000 according to the first exemplary embodiment of the present invention will be described in detail through detailed configurations of the piston rod 310 and the driving part 400.

Figure 4:
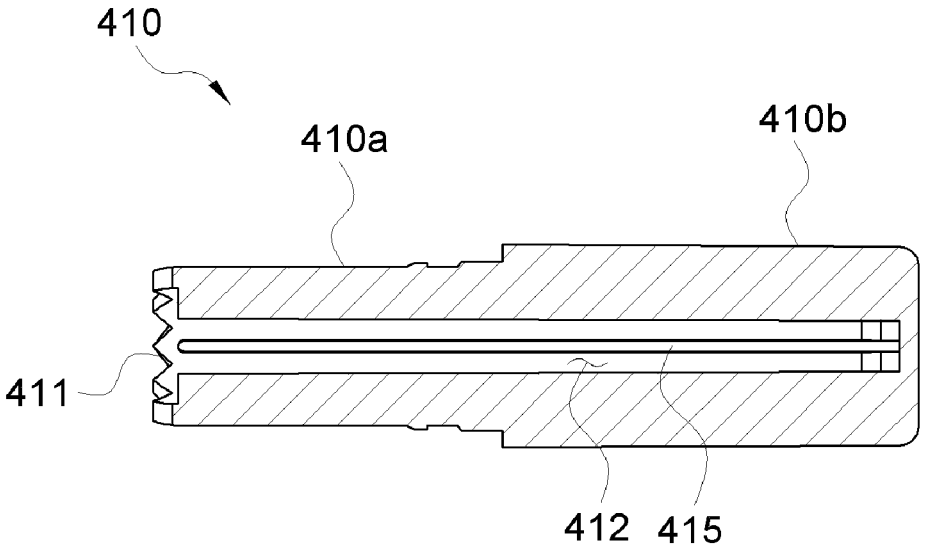
FIG. 4 is a cross-sectional view of a rotor according to the first exemplary embodiment of the present invention.

FIG. 4 illustrates a cross-sectional view of the rotor 410. As illustrated, the rotor 410 generally includes an insertion part 410*a* formed at one side and a handle part 410*b* formed at the other side. The insertion part 410*a* is configured to be inserted into the other side of the body 100 and the handle part 410*b* is configured to be exposed to the outside of the other end of the body 100. Therefore, as the user rotates the handle part 410*b*, the insertion part 410*a* inserted into the body 100 rotates. The tooth grooves 411 may be continuously formed along a periphery at one end of the insertion part 410*a*. The elastic protrusion 421 of the fixing cam 420 described above is engaged with any one of the tooth grooves 411, and the elastic protrusions 421 may be configured to repeat an engagement and disengagement with the plurality of tooth grooves 411 by the rotation of the rotor 410. In this case, the tooth grooves 411 are formed to be symmetrical with each other along the circumferential direction of the rotor 410 so that the elastic protrusions 421 may be smoothly engaged or disengaged when the rotor 410 rotates in one direction as well as the other direction. In addition, a rod insertion space 412 is formed in the rotor 410 along a length direction so that the piston rod 310 is inserted thereinto. Therefore, when the rotor 410 rotates, the piston rod 310 is configured to rotate in conjunction with the rotor 410. In addition, the piston rod 310 may be inserted into the rotor 410 so as to move freely in the length direction while rotating in conjunction with the rotor 410. To this end, on the rotor 410, a guide protrusion 415 guiding a linear reciprocating motion of the piston rod 310 in the length direction thereof may protrude inwardly from the rod insertion space 412 and be formed along the length direction.

Figure 5:
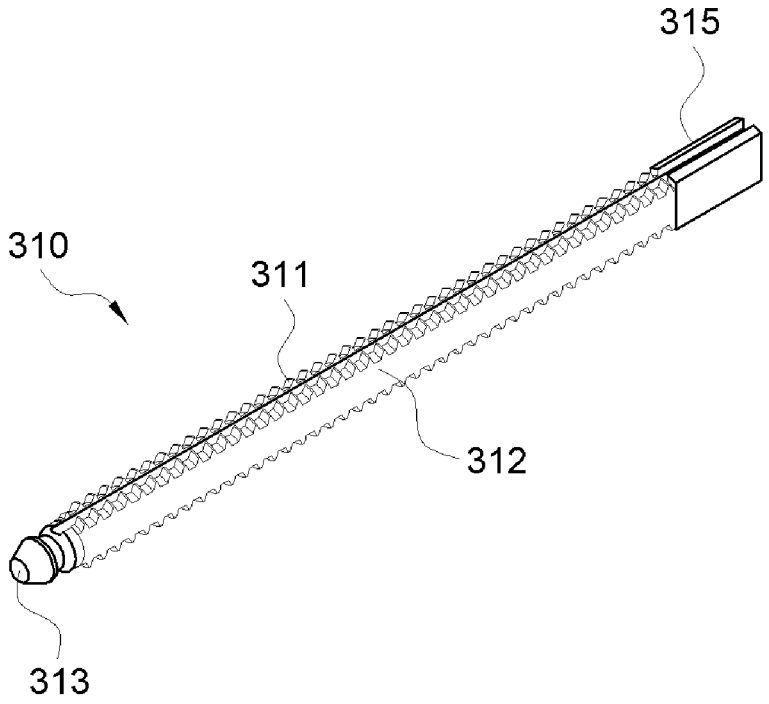
FIG. 5 is a perspective view of a piston rod according to the first exemplary embodiment of the present invention.

FIG. 5 illustrates an overall perspective view of the piston rod 310. As illustrated, a male screw thread 311 is formed on an outer circumferential surface of the piston rod 310, and the male screw thread 311 is screwed with a female screw thread 422 formed in the hollow part of the fixing cam 420 installed in the body 100. In addition, a flat part 312 is formed on a side surface of the piston rod 310 to be fitted and coupled to the rod insertion space 412 of the rotor 410, and is configured to rotate in conjunction with the rotor 410 when the rotor 410 rotates. Therefore, the piston rod 310 moves in one side of the length direction due to a screw coupling with the fixing cam 420 to move the piston 300 forward when the piston rod 310 rotates in one direction, and moves in the other side of the length direction to move the piston 300 backward when the piston rod 310 rotates in the other direction. Therefore, a rotational coupling part 313 for rotatably coupling with the piston 300 is formed at one side end portion of the piston rod 310. In addition, as described above, the other end portion of the piston rod 310 is fitted and coupled to the rod insertion space 412 of the rotor 410 and is coupled thereto so as to be freely moved in the length direction, and a guide groove 315 engaged with the guide protrusion 415 of the piston rod 310 is formed to guide the linear reciprocating motion of the piston rod 310. The guide groove 315 is depressed inwardly from an outer surface of the piston rod 310 and is formed along the length direction.

Figure 6:
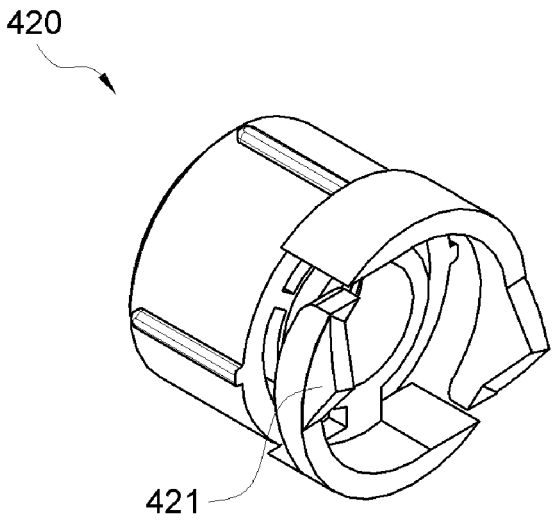
FIG. 6 is a perspective view of a fixing cam according to the first exemplary embodiment of the present invention.
Figure 7:
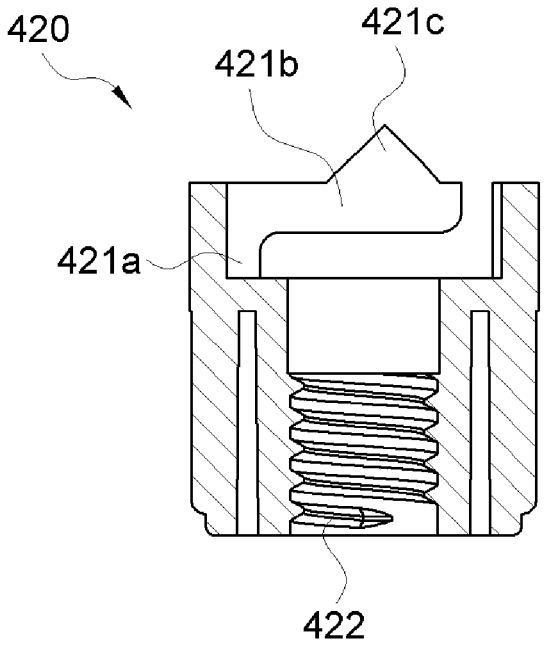
FIG. 7 is a cross-sectional view of the fixing cam according to the first exemplary embodiment of the present invention.
Figure 8A:
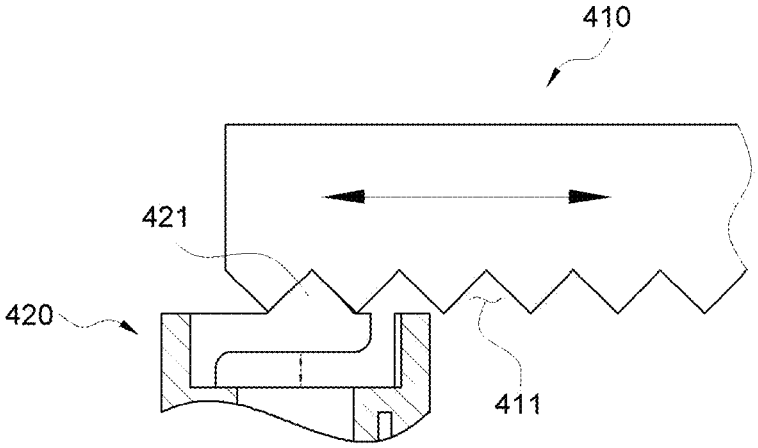
FIGS. 8A and 8B are front views of operation states of the rotor and the fixing cam according to the first exemplary embodiment of the present invention
Figure 8B:
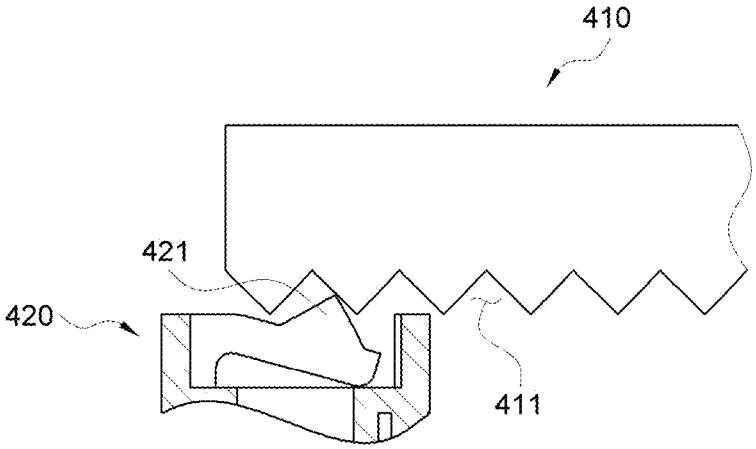

FIG. 6 illustrates a perspective view of the fixing cam 420 and FIG. 7 illustrates a cross-sectional view of the fixing cam 420. As illustrated, the fixing cam 420 is formed in a cylindrical shape having an inner portion hollowed along the length direction. In addition, FIG. 8A illustrates a front view illustrating a state in which the elastic protrusion 421 of the fixing cam 420 is engaged with the tooth groove 411 and FIG. 8B illustrates a front view illustrating a state in which the elastic protrusion 421 of the fixing cam 420 is deviated from and disengaged with the tooth groove 411 of the rotor 410.

The elastic protrusion 421 is formed at an end portion of the other side of the fixing cam 420 and the female screw thread 422 is formed on an inner circumferential surface of the fixing cam 420 along the length direction. The elastic protrusion 421 is configured to repeat the engagement or the disengagement with the tooth groove 411 through elasticity when the rotor 410 rotates. That is, the elastic protrusion 421 serves to induce the user to rotate the rotor 410 by a pitch between the tooth groove 411 and a neighboring tooth groove through an operation of engaging with the neighboring tooth groove in a state in which the elastic protrusion 421 is engaged with the tooth groove 411. In addition, the elastic protrusion 421 is configured to repeat the engagement or the disengagement with the tooth groove 411 through elasticity even when the rotor 410 rotates in one direction as well as the other direction, such that the elastic protrusion 421 smoothly operates even when the nozzle part 200 recovers the contents.

To this end, the elastic protrusion 421 may include a support part 421*a* extended in the other side direction from the end portion of the other side of the fixing cam 420, an elastic piece 421*b* extended along the circumferential direction of the fixing cam 420 from an end of the support part 421*a*, and a tooth protrusion 421*c* protruding in the other side direction from an end of the elastic piece 421*b*. The elastic protrusion 421 is formed of a resin material having elastic force and is configured so that the tooth protrusion 421*c* may perform an elastic reciprocating motion along the length direction through the elastic piece 421*b*. Although it is illustrated in the drawings that pair of elastic protrusions 421 facing each other are provided, a plurality of elastic protrusions may also be radially disposed and a single elastic protrusion may also be provided.

Second Exemplary Embodiment (Knock Hybrid Type)

Figure 9:
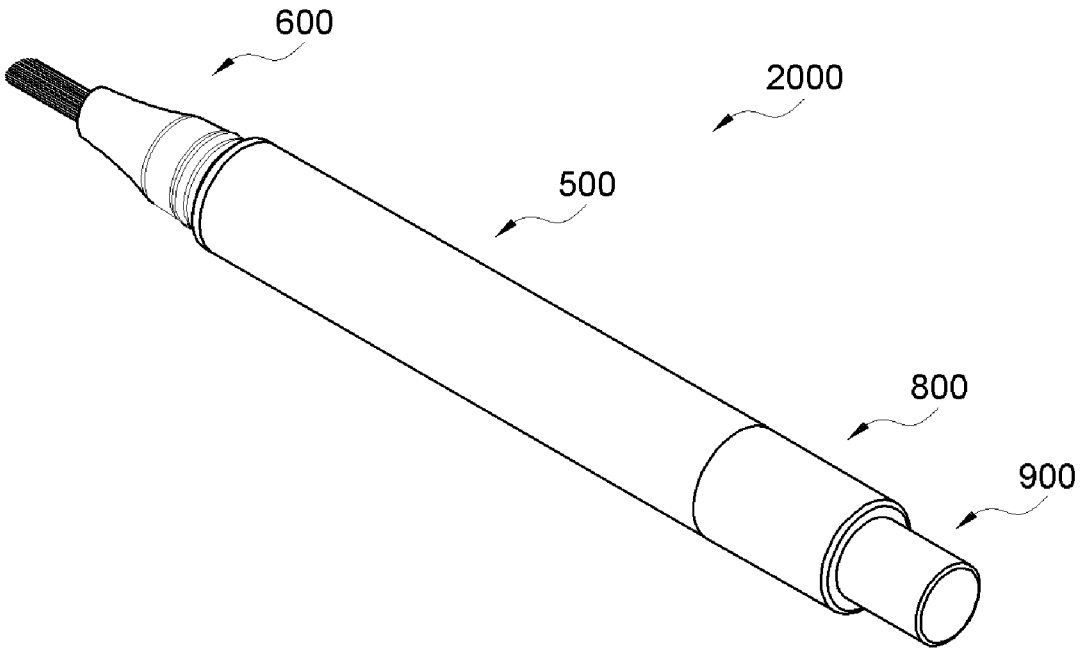
FIG. 9 is an overall perspective view of a pen type cosmetics case according to a second exemplary embodiment of the present invention.
Figure 10:
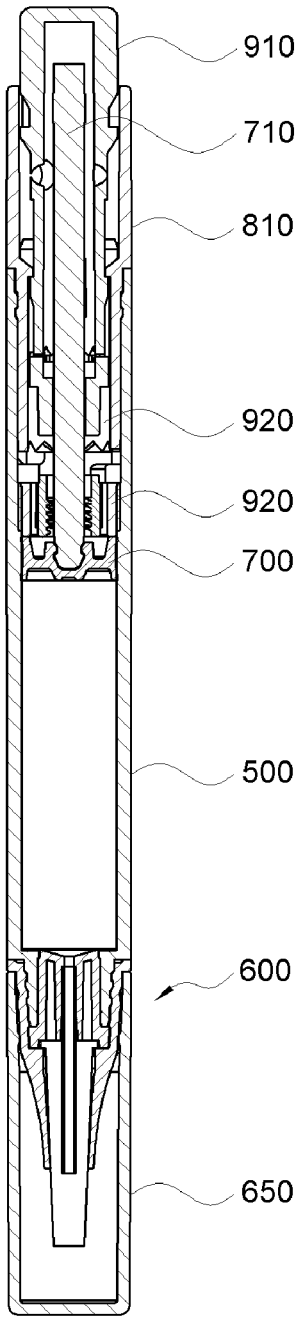
FIG. 10 is a cross-sectional view of the pen type cosmetics case according to the second exemplary embodiment of the present invention.

FIG. 9 is an overall perspective view of a pen type cosmetics case 2000 (hereinafter, referred to as a "case") according to a second exemplary embodiment of the present invention and FIG. 10 is a cross-sectional view of the pen type cosmetics case 2000 according to the second exemplary embodiment of the present invention.

Referring to FIGS. 9 and 10, the case 2000 may generally include a body 500, a nozzle part 600, a piston 700, a piston rod 710, a driving part 800, and a knock part 900, and the driving part 800 may include a rotor 810 and a fixing cam 820 and the knock part 900 may include a knock button 910, a rotary cam 920, and an elastic spring 930. Although the nozzle part 600 is illustrated on the drawing to include a brush 610, the nozzle part including one of various configurations such as a brush, a sponge, and a porous resin for the role of an eyeliner, a concealer, a lip tint or a lip gloss may be applied. A description will be made by defining the nozzle part 600 side as one side and defining the knock part 900 side as the other side in relation to a length direction of the body 500 for convenience.

Among the above-mentioned configurations, since the body 500, the nozzle part 600, the piston 700, and the piston rod 710 are the same as the configurations of the body 100, the nozzle part 200, the piston 300, and the piston rod 310 of the case 1000 according to the first exemplary embodiment, a detailed description thereof will be omitted. Since the case 2000 according to the second exemplary embodiment of the present invention is characterized in that the piston rod 710 is rotated through the knock part 900 separately from the driving part 800 as a means for injecting the contents into the nozzle part 600, detailed configurations of the driving part 800 and the knock part 900 will hereinafter be described with reference to the drawings.

Figure 11:
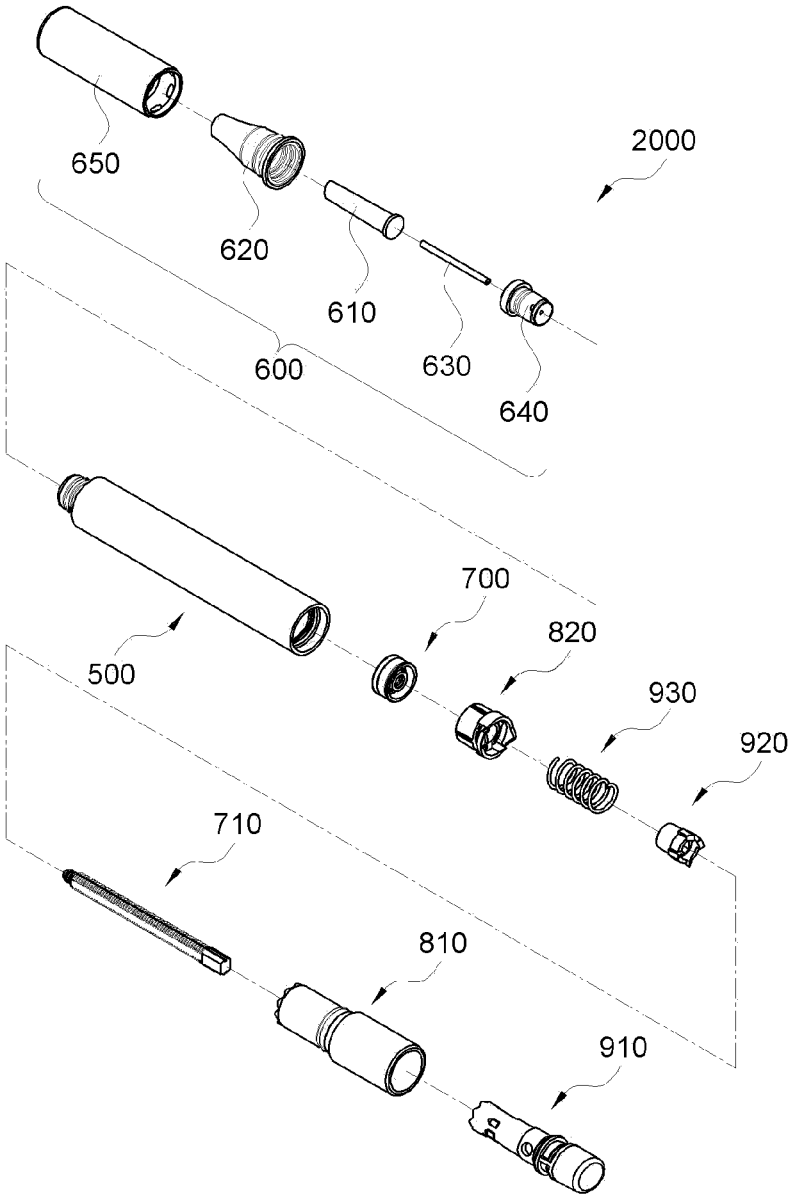
FIG. 11 is an exploded perspective view of the pen type cosmetics case according to the second exemplary embodiment of the present invention.
Figure 12:
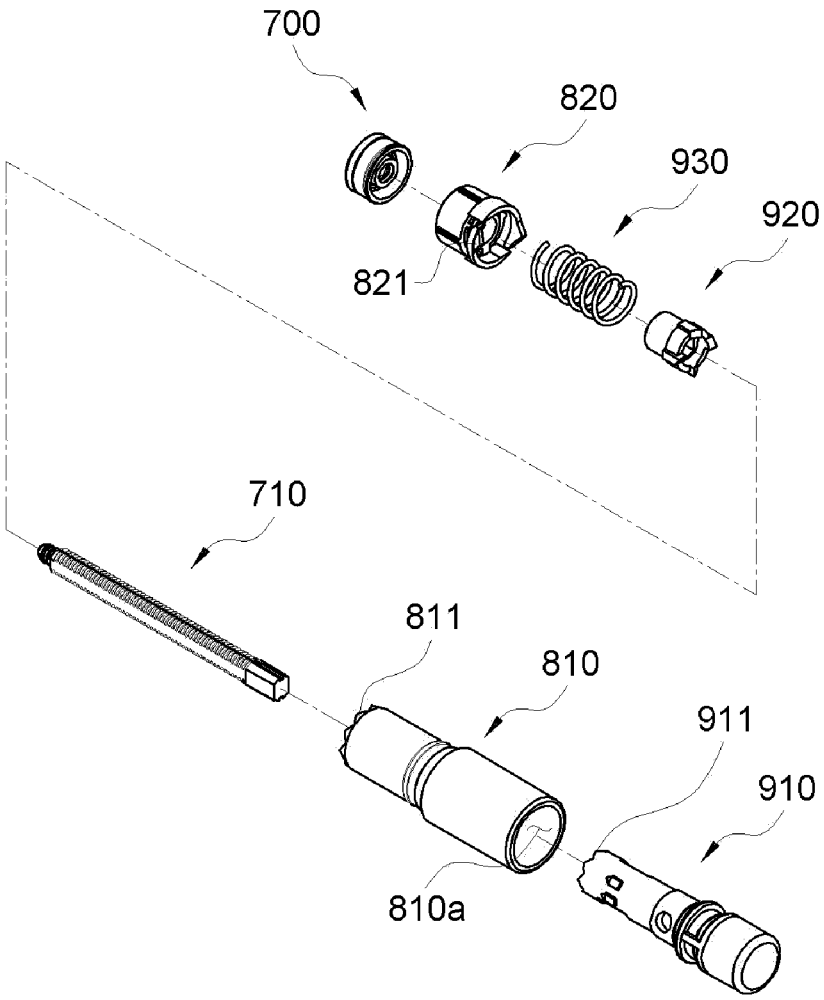
FIG. 12 is an exploded perspective view of the pen type cosmetics case according to the second exemplary embodiment of the present invention.

FIG. 11 illustrates an exploded perspective view of a case 2000 according to a second exemplary embodiment of the present invention and FIG. 12 illustrates an exploded perspective view of main parts of the case 2000 according to the second exemplary embodiment of the present invention.

As illustrated, the driving part 800 includes a rotor 810 rotatably coupled to the other side of the body 500 and a fixing cam 820 fixed to an inner portion of the other side of the body 500. The rotor 810 is exposed to the outside to allow the user to apply rotational force, and is configured to rotate the piston rod 710 through rotation. In this case, the rotor 810 is formed in a hollowed cylindrical shape and the other end thereof may be opened so that the knock button 910 of the knock part 900 is accommodated therein. The rotor 810 is exposed to the outside to allow the user to apply rotational force, and is configured to rotate the piston rod 710 through rotation. The fixing cam 820 is configured to be screwed with the piston rod 710 to move the piston rod 710 to one side or the other side in the length direction when the piston rod 710 rotates. In addition, a plurality of tooth grooves 811 are formed along a circumferential direction at one end of the rotor 810 and elastic protrusions 821 are formed at the other end of the fixing cam 820 such that the elastic protrusions 821 are periodically engaged with the tooth grooves 811 to thereby induce rotation of the rotor 810 to inject or recover the contents into or from the nozzle by an amount that the user intends. Here, since a shape of the piston rod 710, a shape of the fixing cam 820, a driving mechanism of the piston rod 710 and the fixing cam 820, and a coupling structure of the rotor 810 and the fixing cam 820 are the same as those of the first exemplary embodiment described above, a detailed description thereof will be omitted.

Hereinafter, a coupling structure and a driving mechanism of the piston rod 710, the rotor 810, and the knock part 900 will be described in detail through a detailed description of the knock part 900.

Figure 13:
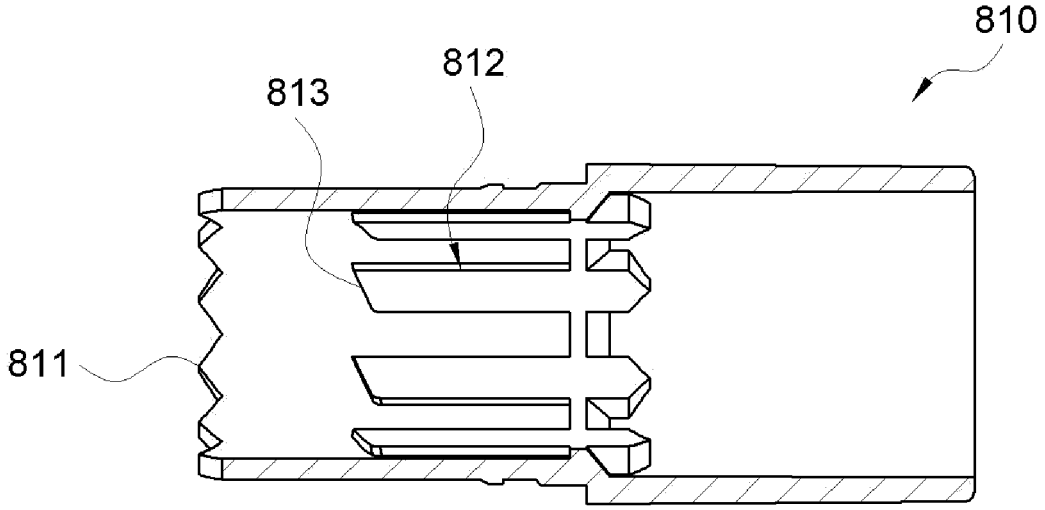
FIG. 13 is a cross-sectional view of a rotor according to the second exemplary embodiment of the present invention.
Figure 14:
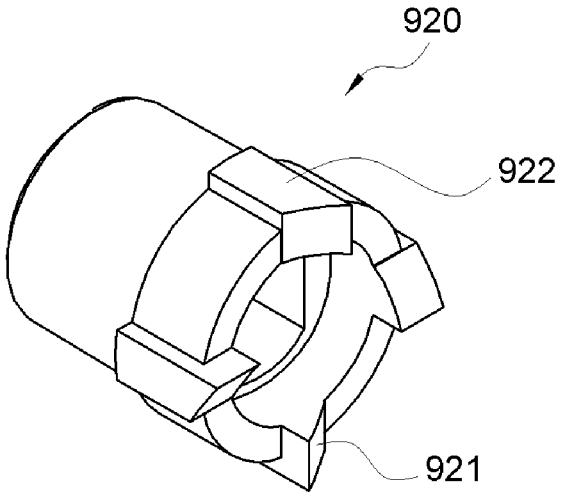
FIG. 14 is a perspective view of a rotary cam according to the second exemplary embodiment of the present invention.
Figure 15:
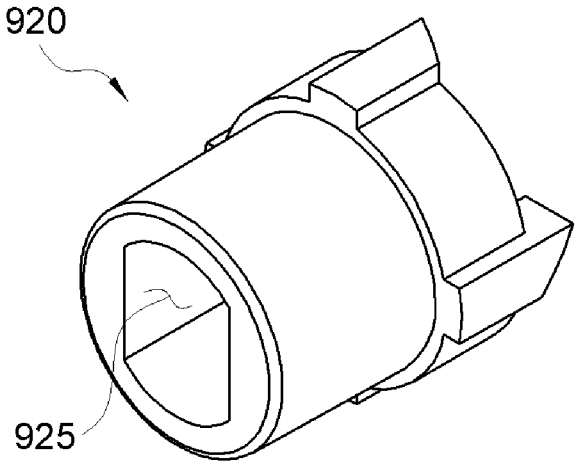
FIG. 15 is a perspective view of the rotary cam according to the second exemplary embodiment of the present invention when being viewed at another angle.

FIG. 13 illustrates a cross-sectional view of the rotor according to the second exemplary embodiment of the present invention and FIGS. 14 and 15 illustrate perspective views of the rotary cam 920 according to the second exemplary embodiment of the present invention.

Referring to FIGS. 12 to 15, the knock part 900 includes the knock button 910 and the rotary cam 920. The knock button 910 is configured so that one end portion thereof is accommodated in the rotor 810 and the other end portion thereof is exposed to the outside to be moved to one side by a push of a user. Gear protrusions 911 are formed at one end of the knock button 910 along a circumferential direction and are configured to be engaged with inclined surface gears 921 formed at the other side of the rotary cam 920 when the knock button 910 moves in one direction to rotate the rotary cam 920. A rod insertion hole 925 is formed in a center of the rotary cam 920 so that the other end portion of the piston rod 710 is inserted into the rod insertion hole 925 along the length direction, and the rotary cam 920 is configured to rotate in conjunction with the piston rod 710 when the rotary cam 920 rotates. The rod insertion hole 925 may have any shape as long as it may rotate the inserted piston rod 710 when the rotary cam 920 rotates, and may be preferably formed in a shape corresponding to a cross section shape of the piston rod 710. Therefore, when the rotary cam 920 rotates through the movement of the knock button 910 in one side of the length direction thereof, the piston rod 710 rotates in conjunction with the rotary cam 920 by a length of the rotation of the rotary cam 920, and the piston rod 710 screwed with the fixing cam 820 moves in one direction by the length of the rotation to move the piston 700 forward.

In this case, the rotary cam 920 has the following configuration to rotate the piston rod 710 by rotating in conjunction with the rotation of the rotor 810 as well as the movement of the knock button 910. That is, unlike the first exemplary embodiment described above, in the case according to the second exemplary embodiment, the piston rod 710 is not directly connected to the rotor 810, but rotates through the rotary cam 920 when the rotor 810 rotates.

Referring to FIGS. 13 and 14, the rotary cam 920 may be inserted into an inner surface of one end portion of the rotor 810. In the rotary cam 920, as described above, the inclined surface gears 921 corresponding to the gear protrusions 911 formed at one end of the knock button 910 are formed at the other end of the rotary cam 920, and side surface protrusion gears 922 engaged with inward protrusion gears 812 formed inside the rotor 810 at the time of inserting the rotor 810 are formed on an outer circumferential surface of the rotary cam 920. The inward protrusion gears 812 are formed inside the rotor 810 and are engaged with the side surface protrusion gears 922 as described above.

Therefore, the rotary cam 920 is usually engaged with the rotor 810 so as to rotate in conjunction with the rotor 810 when the rotor 810 rotates, and the piston rod 710 rotates through the rotation of the rotary cam 920. In this case, since the rotary cam 920 rotates in conjunction with the rotor 810, both the one direction rotation and the other direction rotation are possible.

In addition, in a case in which the knock button 910 moves in one side direction to rotate the rotary cam 920 so that the rotary cam 920 is rotated by the knock button 910 separately from the rotor 810, the rotary cam 920 is also pushed in one side direction due to a push of the knock button 910 and the side surface protrusion gears 922 are disengaged from the inward protrusion gears 812 of the rotor 810, thereby rotating the rotary cam 920 by the knock button 910.

According to the configuration described above, in a pen type cosmetics case in which the cosmetics are pushed from the case 2000 and are used by pushing the knock button 910 to move the piston forward, it is possible to recover excessively pushed cosmetics by rotating the rotor 810 to move the piston backward.

An operation example of the case 2000 will be described in more detail. In order to push the cosmetics stored in the body 500 of the case 2000, the user pushes the knock button 910. The gear protrusions 911 installed at a lower end of the pushed knock button 910 are engaged with the inclined surface gears 921 of the rotary cam 920 elastically supported by an elastic spring 930, and the gear protrusions 911 push inclined surfaces of the inclined surface gears 921 to thereby rotate the rotary cam 920.

The rotary cam 920 is elastically supported by the spring 930, and when the knock button 910 is not pushed, the side surface protrusion gears 922 of the rotary cam 920 are engaged with the inward protrusion gears 812 of the rotor 810, and when the knock button 910 is pushed, the rotary cam 920 is pushed out such that the side surface protrusion gears 922 of the rotary cam 920 are deviated from the inward protrusion gears 812 of the rotor 810. As a result, when the rotary cam 920 rotates, the rotor 810 maintains a fixed state. In order to facilitate returning the rotary cam 920 to a position at which the rotary cam 920 engages the inward protrusion gears 812 by the spring 930, inclined parts 813 may be formed on the inward protrusion gears 812. The side surface protrusion gears 922 of the rotary cam 920 may be seated at positions at which the side surface protrusion gears 922 are engaged with the inward protrusion gears 812 by receiving a guide of the inclined parts 813 while being raised by the spring 930.

As the rotary cam 920 rotates, the piston rod 710 installed at the center of the rotary cam 920 rotates. The piston rod 710 is configured to be rotatable in accordance with the rotation of the rotary cam 920. The piston rod 710 rotates together with the rotary cam 920, but is configured to be freely movable in the length direction thereof.

Third Exemplary Embodiment (Stick Type)

Figure 16:
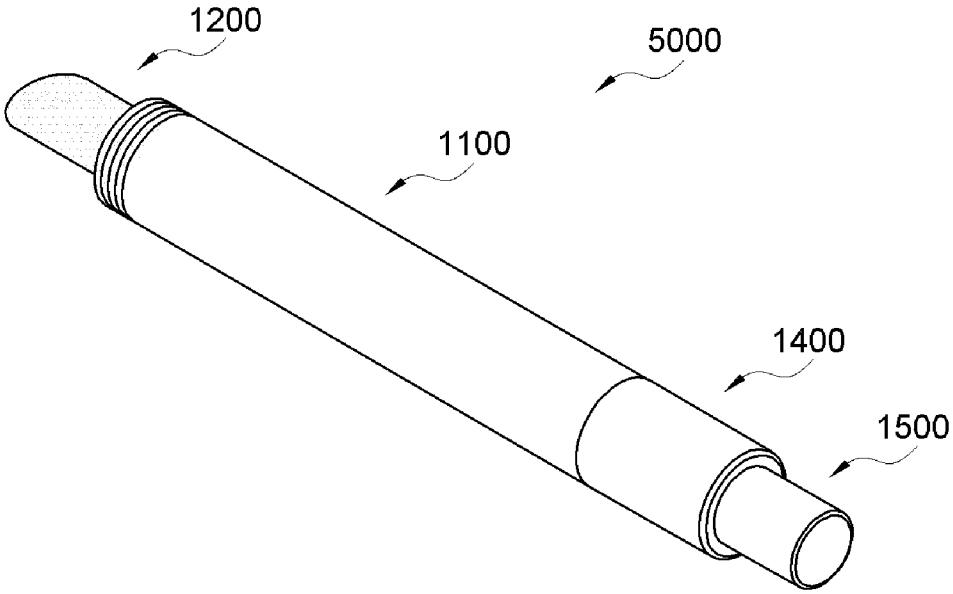
FIG. 16 is a perspective view of a pen type cosmetics case according to a third exemplary embodiment of the present invention.
Figure 17:
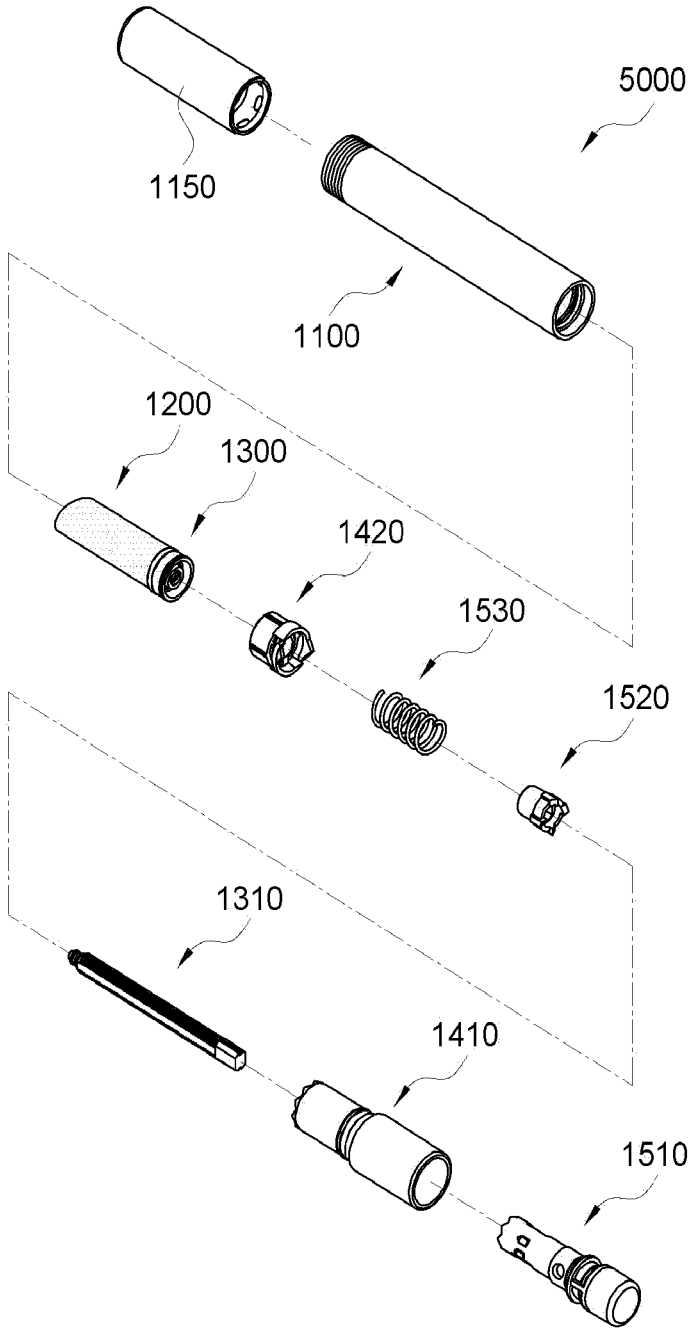
FIG. 17 is an exploded perspective view of the pen type cosmetics case according to the third exemplary embodiment of the present invention.
Figure 18:
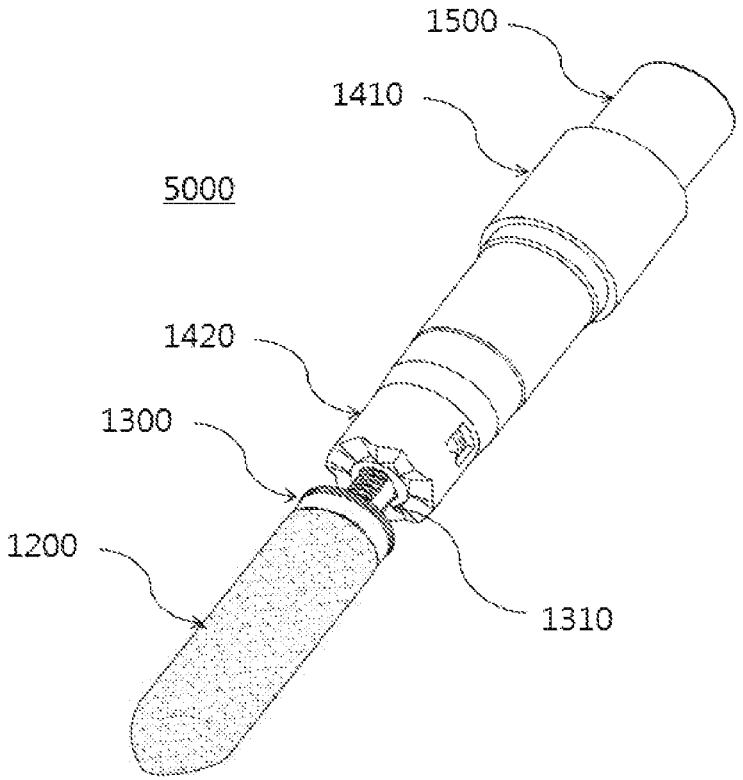
FIG. 18 is a partial perspective view of the pen type cosmetics case according to the third exemplary embodiment of the present invention.

FIG. 16 illustrates a perspective view of a pen type cosmetics case 5000 according to a third exemplary embodiment of the present invention, FIG. 17 illustrates an exploded perspective view of the pen type cosmetics case 5000 according to the third exemplary embodiment of the present invention, and FIG. 18 illustrates a perspective view of the remaining configurations except for a body 1100 of the pen type cosmetics case 5000 according to the third exemplary embodiment of the present invention.

Referring to FIGS. 16 to 18, the case 5000 may generally include a body 1100, solid contents 1200, a piston 1300, a piston rod 1310, a driving part 1400, and a knock part 1500, and the driving part 1400 may include a rotor 1410 and a fixing cam 1420 and the knock part 1500 may include a knock button 1510, a rotary cam 1520, and an elastic spring 1530. In addition, the case 5000 may further include a protective cap 1150 for protecting the contents. According to the present exemplary embodiment, unlike the first and second exemplary embodiments described above, the solid contents 1200, for example, a lipstick, and the like may be accommodated in the body 1100. A description will be made by defining a side to which the solid contents 1200 protrude as one side and defining the knock part 1500 side as the other side in relation to a length direction of the body 1100 for convenience. Since the configurations of the body 1100, the piston 1300, the piston rod 1310, the driving part 1400, and the knock part 1500 are the same as those of the body 500, the piston 700, the piston rod 710, the driving part 800, and the knock part 900 according to the second exemplary embodiment described above, a detailed description thereof will be omitted and an operation example will be described.

The user may select one of a method for rotating the rotor 1410 in one direction and a method for pushing the knock button 1510 to move the solid contents forward. However, the solid contents 1200 move forward by the rotation of the rotor 1410, and when the knock button 1510 is pushed once, the knock button 1510 moves forward by a rotation pitch of the rotary cam 1520. Next, in order to move the solid contents backward, only a method for rotating the rotor 1410 in the other direction is possible, and the rotor 1410 is rotated until the solid contents 1200 are accommodated in the body 1100 to thereby prevent the solid contents 1200 from being damaged.

Since the pen type cosmetics case according to the present invention having the configuration as described above may recover the contents injected into the nozzle, the pen type cosmetics case recovers the excessively injected contents in the case in which the contents are excessively injected into the nozzle, thereby making it possible to allow an appropriate amount of contents to be used in a state in which the appropriate amount of contents are injected into the nozzle and to reduce waste of the contents.

In addition, since the contents may be stored in a state in which the contents injected into the nozzle are recovered, it is possible to prevent unavailability of the nozzle and the clogging of the nozzle due to the solidified contents of the nozzle, thereby solving a trouble due to cleaning of the nozzle in reuse.

In addition, since the protrusions and the tooth grooves are engaged with each other at a predetermined interval when the rotary operation part is used, it is possible to induce an appropriate amount of the contents to be injected or recovered as the user forwardly moves or backwardly moves the piston at a predetermined interval.

In addition, the knock scheme may be selectively used at the time of injecting the contents into the nozzle, thereby increasing use convenience.

Further, the piston is moved backward by using the rotary operation part after use to keep the inside of the case at a reduced pressure state, thereby making it possible to prevent contamination of the case due to the outflow of the contents when moving the case.

A technical spirit of the present invention should not be construed to being limited to the above-mentioned exemplary embodiments. The present invention may be applied to various fields and may be variously modified by those skilled in the art without departing from the scope of the present invention claimed in the claims. Therefore, it is obvious to those skilled in the art that these alterations and modifications fall in the scope of the present invention.

What is claimed is:

1. A pen type cosmetics case comprising:

a body having contents accommodated therein;

a nozzle part coupled to one end of the body in a length direction thereof to discharge the contents;

a piston coupled at one side of the piston to an inner portion of the body so as to perform a reciprocating motion along the length direction of the body;

a piston rod coupled to an other side of the piston and having a screw thread formed on an outer surface thereof;

a fixing cam coupled to the other side of the body and having a screw thread formed on an inner surface such that the screw thread on the piston rod is threadedly engaged with the screw thread on the fixing cam; and a rotor coupled rotatably to the other side of the body and connected to the other side of the piston rod, wherein the piston rod rotates in conjunction with the rotor, and the piston rod moves the piston forward when the rotor rotates in one direction, and moves the piston backward when the rotor rotates in the other direction, further comprising a knock part included in the rotor and moving the piston rod to one side in the length direction separately from the rotation of the rotor.

2. The pen type cosmetics case of claim 1, wherein the contents are injected into the nozzle part when the piston moves to one side and are recovered from the nozzle part when the piston moves to the other side.

3. The pen type cosmetics case of claim 1, wherein a plurality of tooth grooves are formed at a predetermined interval along a circumference direction in a periphery of one end of the rotor, an elastic protrusion is formed at an other end of the fixing cam so as to be engaged with any one tooth groove of the tooth grooves, and when the rotor rotates, the elastic protrusion is sequentially engaged with the plurality of tooth grooves.

4. The pen type cosmetics case of claim 3, wherein the elastic protrusion includes:

a support extended from one end of the fixing cam;

an elastic piece extended along a periphery of the fixing cam from the support; and the elastic protrusion protruding from an end of the elastic piece to the other side.

5. The pen type cosmetics case of claim 3, wherein a movement distance to one side or an other side of the piston is induced by a pitch between the tooth groove and a neighboring tooth groove when the rotor rotates.

6. The pen type cosmetics case of claim 1, wherein the knock part includes:

a knock button provided to perform a reciprocating motion along the length direction on the rotor and having one end inserted into the rotor and an other end exposed to the outside; and a rotary cam provided inside the rotor so as to be rotatable adjacent to one side of the knock button and to which the other end of the piston rod is inserted so that the piston rod rotates in conjunction with the rotary cam, a gear is formed at one end of the knock button and an inclined surface gear engaged with the gear is formed at the other end of the rotary cam, such that when the knock button moves to one side of the length direction, the rotary cam rotates in one direction by a pitch of the inclined surface gear, and the piston rod rotates by a rotation length of the rotary cam.

7. The pen type cosmetics case of claim 6, wherein the rotary cam is inserted into the rotor and has a side surface protrusion gear engaged with an inward protrusion gear formed inside the rotor so as to rotate in conjunction with the rotor, the side surface protrusion gear being formed on an outer circumferential surface of the rotary cam, and when the knock button moves to one side of the length direction, the rotary cam is pushed to one side direction by the knock button and the side surface protrusion gear is disengaged from the inward protrusion gear.

8. The pen type cosmetics case of claim 6, wherein the knock part includes an elastic spring elastically supporting the rotary cam so that the knock button returns to the other side after moving to one side.

9. A pen type cosmetics case comprising:

a body having a hollowed inner portion and open on opposite sides thereof;

a piston coupled to the inner portion of the body so as to perform a reciprocating motion along a length direction of the body;

solid contents accommodated in the body and coupled to one side of the piston;

a piston rod coupled to an other side of the piston and having a screw thread formed on an outer surface thereof;

a fixing cam coupled to one side of the body and having a screw thread formed on an inner surface such that the screw thread on the piston rod is threadedly engaged with the screw thread on the fixing cam; and a rotor coupled rotatably to an other side of the body and connected to an other side of the piston rod, wherein the piston rod rotates in conjunction with the rotor, and the piston rod moves the piston forward when the rotor rotates in one direction, and moves the piston backward when the rotor rotates in the other direction, further comprising a knock part included in the rotor and moving the piston rod to one side in the length direction separately from the rotation of the rotor.

10. The pen type cosmetics case of claim 9, wherein the solid contents moves forward to an outside of one side of the body when the piston moves to one side and are recovered into the inner portion of the body when the piston moves to the other side.

11. The pen type cosmetics case of claim 9, wherein a plurality of tooth grooves are formed at a predetermined interval along a circumference direction in a periphery of one end of the rotor, an elastic protrusion is formed at an other end of the fixing cam so as to be engaged with any one tooth groove of the tooth grooves, and when the rotor rotates, the elastic protrusion is sequentially engaged with the plurality of tooth grooves.

* * * * *